United States Patent [19]

Sherman

[11] Patent Number: 4,928,394

[45] Date of Patent: May 29, 1990

[54] SIGHT FOR ARCHERY BOW

[76] Inventor: James R. Sherman, 2961 Rudo Rd., Urofino, Id. 83544

[21] Appl. No.: 331,833

[22] Filed: Apr. 3, 1989

[51] Int. Cl.[5] ..... F41G 1/46; F41G 1/34

[52] U.S. Cl. ..... 33/265; 124/87

[58] Field of Search ..... 33/265; 124/87; 350/96.23, 96.24

[56] References Cited

U.S. PATENT DOCUMENTS

| | | | |
|---|---|---|---|
| 2,155,169 | 4/1939 | Moses | 33/177 |
| 3,945,127 | 3/1976 | Spencer | 33/265 |
| 4,166,324 | 9/1979 | Carollo et al. | 33/265 X |
| 4,170,071 | 10/1979 | Mann | 33/265 |
| 4,177,572 | 12/1979 | Hindes | 33/265 |
| 4,400,887 | 8/1983 | Mason | 33/265 |
| 4,535 747 | 8/1985 | Kudlacek | 124/87 |
| 4,603,942 | 8/1986 | Chang et al. | 350/96.23 X |

*Primary Examiner*—Harry N. Haroian

*Attorney, Agent, or Firm*—James D. Givnan, Jr.

[57] ABSTRACT

A sight base includes an upright pair of guides on which sight pin carriers are slidably mounted. Fiber optics are carried by the base with a fiber optic end, constituting an illuminated sight bead, carried by a tubular sight pin on each sight pin carrier. The remaining ends of the fiber optics are bundled in a positionable sleeve for light gathering purposes.

5 Claims, 1 Drawing Sheet

SIGHT FOR ARCHERY BOW

BACKGROUND OF THE INVENTION

The present invention concerns generally archery bow sights having vertically adjustable sight components for registration with targets at different distances.

In the prior art are various bow sights providing sight pins or other indices vertically spaced from one another to permit sighting of the bow at different target distances. When shooting game, sight pin selection is based on the estimated range of the animal. In hunting wild game, various adverse conditions may be encountered one of which is poor lighting which renders sight registration with the animal difficult and time consuming. This is particularly so when there is little color differential between the animal and adjacent cover.

U.S. Pat. No. 4,535,747 discloses an archery sight having sight pins vertically spaced from one another wth sight pins alternately carried in parallel slots and with a sight pin guard enclosing the sight pins. Setscrews lock the pins against shifting and against pin rotation.

SUMMARY OF THE PRESENT INVENTION

The present invention concerns an archery bow sight having independently adjustable sight pins which may be illuminated to facilitate sighting of the bow on a target.

The present sight includes guide means on which one or more sight pin carriers are mounted in a vertically adjustable manner. A base of the sight is attached to an archery bow by means of a mounting block and plate arrangement permitting a wide range of sight and bow combinations. Accordingly, the present sight is suitable for mounting on a majority of archery bows whether compound, long or reverse curve type. The base carries the sight pins in a manner permitting unencumbered elevation adjustment between consecutive sight pins by reason of same being laterally spaced from one another. The sight pins carry a fiber optic which terminates at a remote end at a light source. The fiber optics are of a flexible nature to permit adjustment of the sight pins.

Important objectives of the present archery sight include the provision of a sight which supports a plurality of C-shaped sight pin carriers some of which are offset from one another to permit unobstructed vertical adjustment and setting of same in very close proximity to one another; the provision of an archery sight having tubular sight pins within which are housed end segments of fiber optics to illuminate the sight pins; the provision of an archery sight having fiber optics which terminate in end segments which are positionable for optimum light reception; the provision of an archery sight having a multitude of fiber optics which are joined at their corresponding ends and thereat combined with a stiffener element for retention of optic end segments in a canted relationship to the sight for purposes of light reception.

DETAILED DESCRIPTION OF THE PREFERRED EMBODIMENTS

Figure 1:
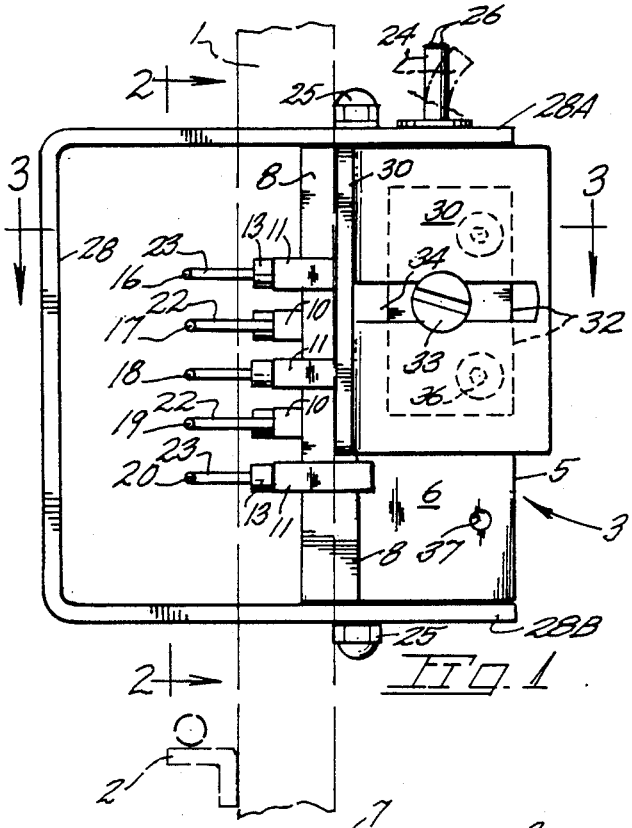
FIG. 1 is a rear elevational view of the sight as viewed by an archer during sight use.

With continuing attention to the drawings wherein applied reference numerals indicate parts similarly hereinafter identified, the reference numeral 1 indicates the riser of an archery bow which is that portion of a bow immediately above the bow handgrip portion of the riser. An arrow rest is at 2.

The present sight includes a base generally at 3 of upright, elongate configuration and defining an open area 4 by means of an end wall 5 and side walls 6. Upright guide means on each side wall includes a guide 7 and a guide 8. Each guide includes an upright, elongate slot 7A-8A.

Slidably disposed on each guide of the guide means are sight pin carriers at 10 and 11 with each carrier internally shaped and sized to correspond closely to a guide cross section to permit stable or precise movement of the pin carrier along its guide. The pin carriers are somewhat C-shaped to permit a clamping screw at 12-13 to close or bias the carrier into clamped engagement with its guide. Inner extremities 14 and 15 of the pin carriers are located in open area 4 of the base and are bored to receive later described fiber optics. The pin carrier extremities 14-15 are in spaced apart vertical planes to permit pin carrier movement along its guide without contact with a pin carrier on the remaining guide.

Figure 2:
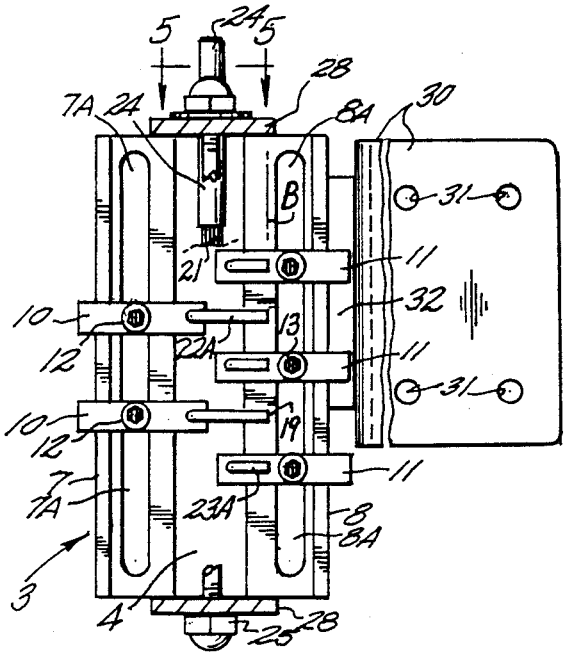
FIG. 2 is a vertical sectional view taken along line 2—2 of FIG. 1.
Figure 3:
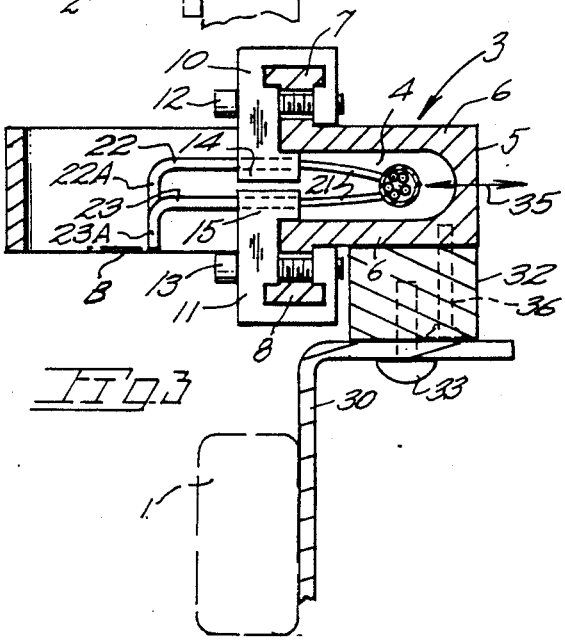
FIG. 3 is a horizontal sectional view taken downwardly along line 3—3 of FIG. 1.
Figure 4:
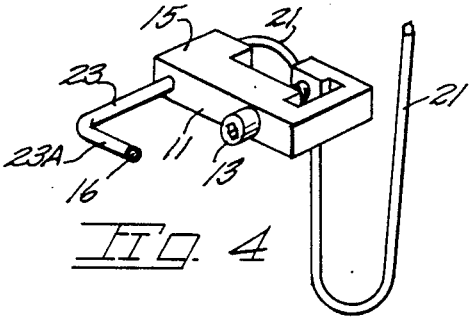
FIG. 4 is a perspective view of a sight pin and sight pin carrier and with a segment of fiber optic removed from the sight.
Figure 5:
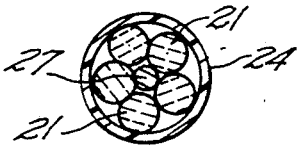
FIG. 5 is a horizontal sectional view taken downwardly along line 5—5 of FIG. 2.

To facilitate drawing a bead on a target, illuminated beads at 16, 17, 18, 19 and 20 are provided of fiber optic means which includes flexible light transmitting members as at 21 one each terminating in one of the above beads. Sight pins at 22-23 are tubular and serve to carry an optic end segment therein and the bead associated therewith. The sight pins are of right angular shape having angled end portions at 22A-23A which are of adequate lengths to locate the fiber optic bead in a plane at B in FIG. 2 for purposes of sighting accuracy. The light transmitting members 21 may move and flex within base open area 4 during sight pin movement. The members 21 are bundled by a sleeve at 24 suitably attached to a sight pin guard 28 which is apertured to receive the sleeve in a snug manner. The sleeve is formed of a pliable material such as PVC to permit angular displacement of the sleeve as per the broken line position of FIG. 1 to position the light receiving end segments 26 of the light transmitting members for optimum light reception. For retention of the sleeve and light receiving ends 26 in a selected angular position, a malleable metal component 27 is included in the bundled end segments 26 of the light transmitting members. A short length of heavy gauge copper wire may serve such a purpose. After sleeve application, the sleeve may be heat shrunk about the end segments 26.

Sight pin guard 28 is of U-shape having parallel upper and lower members 28A-28B which overlie the upper and lower ends of the base and close open area 4. A fastener assembly 25 draws the guard members 28A-28B into frictional engagement with the upper and lower ends of the base.

The installation of base 3 on an archery bow of compound or other type is achieved by mounting means including a plate 30 apertured at 31 in a manner so as to permit plate attachment to bow riser 1 using threaded fasteners now shown. A mounting block at 32 receives a plate attachment screw 33 which extends through a plate slot 34 to permit horizontal or windage adjustment of the remainder of the sight per arrow 35 through a range of positions relative the plate and bow. Mounting block 32 which receives the plate is drilled to receive flat head screws 36 in base defined sockets as at 37. Vertical positioning of the sight base 3 on a specific bow is achieved by the selection of a desired pair of the vertically spaced base sockets. The sight pins 22-23 and beads 16–20 may be moved into close proximity and normally will be set for target (or game) distances of 20 yards through 60 yards.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

1. An archery bow sight comprising, a base having parallel guides each defining a slot, sight pin carriers adjustably mounted on said guides, said carriers of C-shape and including a clamping screw extending through said slot to clamp the carrier to the guide, mounting means for coupling said base to the bow, and fiber optic means including at least one fiber optic having a first end carried by one of said sight pin carriers in the field of vision of an archer during aiming of the bow, said fiber optic having a remaining end for disposition toward a light source.

2. The sight claimed in claim 1 wherein said fiber optic means includes a multitude of fiber optics each having a light receiving end segment, a sleeve of pliable material about said fiber optics, a bendable stiffener element in said sleeve whereby the sleeve and fiber optics therein may be positioned relative said base so as to be be directed toward a light source.

3. The sight claimed in claim 1 wherein said base defines an internal open area, said fiber optic means including multiple fiber optics, a sleeve of a pliable nature about a segment of the multiple fiber optics, said multiple fiber optics routed through said open area of the base and terminating at a point vertically offset from the base.

4. The sight claimed in claim 3 additionally including a bendable stiffener element interiorally of said sleeve whereby the sleeve and fiber optics may be flexed in a set manner toward a light source.

5. The sight claimed in claim 1 wherein each of said sight pin carriers includes a sight pin of angular shape terminating in a fiber optic bead located in a common vertical plane.

* * * * *